US011680345B2

(12) United States Patent
Brinkman et al.

(10) Patent No.: US 11,680,345 B2
(45) Date of Patent: Jun. 20, 2023

(54) KNITTED ARTICLE WITH RAISED STRUCTURE AND METHODS OF MANUFACTURE

(71) Applicant: NIKE, Inc., Beaverton, OR (US)

(72) Inventors: Ashleigh Brinkman, Beaverton, OR (US); Juan L. Aceves Tinajero, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/643,681

(22) Filed: Dec. 10, 2021

(65) Prior Publication Data

US 2022/0098767 A1 Mar. 31, 2022

Related U.S. Application Data

(63) Continuation of application No. 16/509,735, filed on Jul. 12, 2019, now Pat. No. 11,220,766.

(60) Provisional application No. 62/702,248, filed on Jul. 23, 2018.

(51) Int. Cl.
*D04B 1/24* (2006.01)

(52) U.S. Cl.
CPC ..... *D04B 1/24* (2013.01); *D10B 2501/043* (2013.01)

(58) Field of Classification Search
CPC ... D04B 1/26; D04B 1/10; D04B 1/12; D04B 1/24; A43B 1/04; A43B 23/025; A43B 23/0235; D10B 2501/043
See application file for complete search history.

(56) References Cited

U.S. PATENT DOCUMENTS

| | | | | |
|---|---|---|---|---|
| 3,359,610 | A | 12/1967 | Faircloth | |
| 7,396,784 | B2 | 7/2008 | Thiriot | |
| 8,595,878 | B2 | 12/2013 | Huffa et al. | |
| 9,078,488 | B1 * | 7/2015 | Meir | D04B 1/22 |
| 10,458,052 | B2 | 10/2019 | Adami et al. | |
| 11,220,766 | B2 * | 1/2022 | Brinkman | A43B 1/04 |
| 2003/0003264 | A1 | 1/2003 | Rock et al. | |
| 2004/0266293 | A1 | 12/2004 | Thiriot | |
| 2011/0177294 | A1 | 7/2011 | Rock et al. | |
| 2016/0088893 | A1 | 3/2016 | Meir | |
| 2018/0135213 | A1 | 5/2018 | Bell et al. | |
| 2020/0022447 | A1 | 1/2020 | Durrell et al. | |
| 2020/0022456 | A1 | 1/2020 | Brinkman et al. | |

(Continued)

FOREIGN PATENT DOCUMENTS

| | | | |
|---|---|---|---|
| CN | 204566838 | U | 8/2015 |
| CN | 106087217 | A | 11/2016 |
| DE | 102014006212 | A1 | 12/2014 |

(Continued)

*Primary Examiner* — Danny Worrell
(74) *Attorney, Agent, or Firm* — Shook, Hardy & Bacon L.L.P.

(57) ABSTRACT

A knitted article having a first layer and a second layer is described. The first layer is formed from a first yarn having a first shrinkage rate and the second layer is formed by a second yarn having a second shrinkage rate. The shrinkage rate of the first yarn is greater than the shrinkage rate of the second yarn when subjected to heat. Upon heat exposure, the second layer forms a raised structure. The raised structures have a length that is generally perpendicular to the lateral-to-medial course-wise direction of the knitted article. Methods of forming raised structures are also disclosed.

20 Claims, 6 Drawing Sheets

(56) References Cited

U.S. PATENT DOCUMENTS

2020/0121019 A1 4/2020 Bartys et al.

FOREIGN PATENT DOCUMENTS

| | | | |
|---|---|---|---|
| JP | 2015-67912 | A | 4/2015 |
| WO | 03/039280 | A1 | 5/2003 |

* cited by examiner

KNITTED ARTICLE WITH RAISED STRUCTURE AND METHODS OF MANUFACTURE

RELATED APPLICATION

The present application is a continuation of Non-Provisional U.S. patent application Ser. No. 16/509,735, filed Jul. 12, 2019, which claims the benefit of the filing date under 35 U.S.C. § 119(e) of Provisional U.S. Patent Application Ser. No. 62/702,248, filed Jul. 23, 2018, the entirety of which is hereby incorporated by reference.

BACKGROUND

A variety of articles are formed from textiles. As examples, articles of apparel (e.g., shirts, pants, socks, footwear, jackets and other outerwear, briefs and other undergarments, hats and other headwear), containers (e.g., backpacks, bags), and upholstery for furniture (e.g., chairs, couches, car seats) are often at least partially formed from textiles. These textiles are often formed by weaving or interlooping (e.g., knitting) a yarn or a plurality of yarns, usually through a mechanical process involving looms or knitting machines. One particular object that may be formed from a textile is an upper for an article of footwear.

Conventional articles of footwear generally include two primary elements: an upper and a sole structure. The upper is secured to the sole structure and forms a void within the article of footwear for comfortably and securely receiving a foot. The sole structure is secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole may be secured to a lower surface of the midsole and forms a ground-engaging portion of the sole structure that is formed from a durable and wear-resistant material.

The upper of the article of footwear generally extends over the instep and toe areas of the foot, along the medial and lateral sides of the foot, and around the heel area of the foot. Access to the void on the interior of the upper is generally provided by an ankle opening in a heel area of the footwear. A lacing system is often incorporated into the upper to adjust the fit of the upper, thereby facilitating entry and removal of the foot from the void within the upper. The upper may include a tongue that extends under the lacing system to enhance adjustability of the footwear, and the upper may incorporate a heel counter to limit movement of the heel.

DESCRIPTION OF THE DRAWINGS

The embodiments will be further described in connection with the attached drawings. It is intended that the drawings included as a part of this specification be illustrative of the exemplary embodiments and should in no way be considered as a limitation on the scope of the present disclosure. Indeed, the present disclosure specifically contemplates other embodiments not illustrated but intended to be included in the claims.

DETAILED DESCRIPTION

Figure 1:
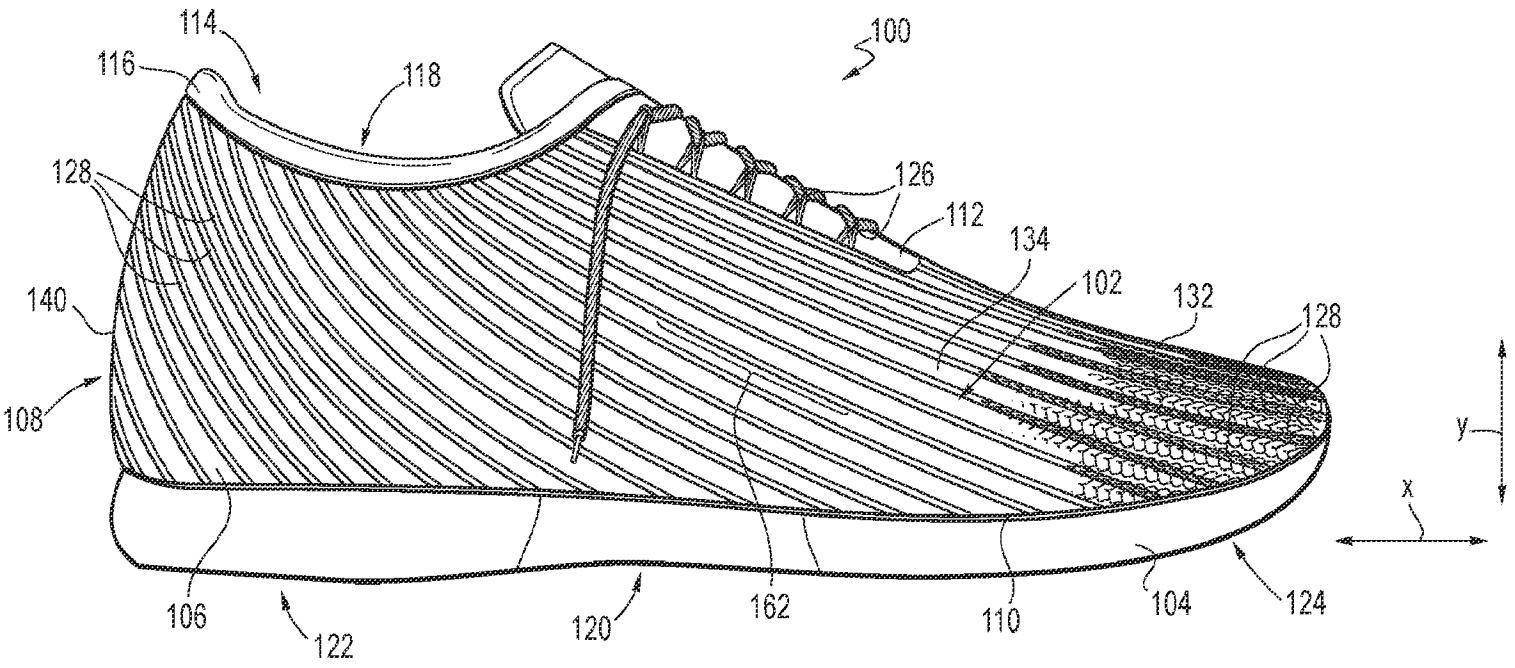
FIG. 1 is an illustration showing a lateral side view of an article of footwear incorporating a knitted component with raised structures in accordance with certain aspects of the present disclosure.

Various aspects are described below with reference to the drawings in which like elements generally are identified by like numerals. The relationship and functioning of the various elements of the aspects may better be understood by reference to the following detailed description. However, aspects are not limited to those illustrated in the drawings or explicitly described below. It also should be understood that the drawings are not necessarily to scale, and in certain instances details may have been omitted that are not necessary for an understanding of aspects disclosed herein, such as conventional fabrication and assembly.

Certain aspects of the present disclosure relate to articles at least partially formed from textiles. One example of an article is an article of apparel (e.g., shirts, pants, socks, footwear, jackets and other outerwear, briefs and other undergarments, hats and other headwear, or the like). The article may be an upper configured for use in an article of footwear. The upper may be used in connection with any type of footwear. Illustrative, non-limiting examples of articles of footwear include a basketball shoe, a biking shoe, a cross-training shoe, a global football (soccer) shoe, an American football shoe, a bowling shoe, a golf shoe, a hiking shoe, a ski or snowboarding boot, a tennis shoe, a running shoe, and a walking shoe. The upper may also be incorporated into a non-athletic shoe, such as a dress shoe, a loafer, and a sandal.

Referring to FIG. 1, an article of footwear 100 may include an upper 102 secured to a sole structure 104. The upper 102 may include a lateral side 106 and a medial side 108. The area of the shoe where the sole structure 104 joins the upper 102 may be referred to as the biteline 110. The upper 102 may be joined to the sole structure 104 in a fixed manner using any suitable technique, such as through the use of an adhesive, by sewing, etc. It is contemplated that the upper 102 may extend partially or completely around the foot of a wearer and/or may be integral with the sole, and a sockliner may or may not be used. In some embodiments, the sole structure 104 may include a midsole (not shown) and an outsole.

The article of footwear 100 may additionally include a throat area 112 and an ankle opening 114, which may be surrounded by a collar 116 and may lead to a void 118. The void 118 of the article of footwear 100 may be configured to accommodate a foot of a person. The throat area 112 may be generally disposed in a midfoot area 120 of the upper 102. The midfoot area 120 is generally an area of the upper 102 located between a heel area 122 and a toe area 124. In some embodiments, a tongue may be disposed in the throat area 112, but a tongue is an optional component. The tongue may be any type of tongue, such as a gusseted tongue or a burrito tongue. If a tongue is not included, the lateral and medial sides of the throat area 112 may be joined together. As shown, in some embodiments, the article of footwear 100 may include an optional fastening element, such as a lace (which may be associated with the lace apertures 126). Any suitable type of fastening element may be used.

The upper may further include one or more structures, including but not limited to, at least one raised structure 128, sometimes referred to herein as a "welt" or "ottoman." The raised structure may be a variety of shapes and sizes, and in one example, may be a generally elongated structure that extends in a direction that is generally perpendicular to the course-wise direction of the knitted component.

The raised structure 128 may be arranged at any suitable location on the article of footwear, such as in the heel area 122, the medial side 108, the lateral side 106, the toe area 124, and/or another location or combination thereof. The raised structure 128 may be formed by two layers that are at least partially overlapping and co-extensive, with a pocket formed therebetween (as described in more detail below). The raised structure 128 may be advantageous for providing the article of footwear 100 with suitable cushioning, rigidity (e.g., without sacrificing flexibility in certain directions), durability, desirable aesthetic properties, or other properties. Any suitable number of raised structures 128 may be included. In some embodiments, a plurality of raised structures 128 may be included. In one non-limiting example, as shown in FIG. 1, a plurality of elongated and parallel raised structures 128 may be present. As shown, the plurality of parallel raised structures 128 extend generally longitudinally between a heel area 122 and a toe area 124. In this embodiment, the course-wise direction of the knitted component extends between the lateral and medial sides of the upper such that the plurality of raised structures 128 (or at least a portion of the plurality of raised structure 128) extend generally longitudinally between a heel area 122 and a toe area 124 are therefore generally perpendicular to the course-wise direction of the knitted component.

At least a portion of the upper 102, and in some embodiments substantially the entirety of the upper 102, may be formed of a knitted component 132, such as a weft-knitting process on a flat knitting machine, for example. The knitted component 132 may additionally or alternatively form another element of the article of footwear, such as an underfoot portion, for example. The knitted component 132 may have a first side 130 forming an inner surface of the upper 102 (e.g., facing the void of the article of footwear) and a second side 134 forming an outer surface of the upper 102 (e.g. facing generally opposite the first side 130). The first side 130 and the second side 134 of the knitted component 132 may exhibit different characteristics (e.g., the first side 130 may provide abrasion resistance and comfort while the second side 134 may be relatively rigid and provide water resistance, among other advantageous characteristics mentioned herein). The knitted component 132 may be formed as an integral one-piece element during a knitting process, such as a weft knitting process (e.g., with a flat knitting machine or circular knitting machine), a warp knitting process, or any other suitable knitting process. That is, the knitting process on the knitting machine may substantially form the knit structure of the knitted component 132 without the need for significant post-knitting processes or steps. Alternatively, two or more portions of the knitted component 132 may be formed separately as distinct integral one-piece elements and then the respective elements attached.

Forming the upper 102 with the knitted component 132 may provide the upper 102 with advantageous characteristics including, but not limited to, a particular degree of elasticity (for example, as expressed in terms of Young's modulus), breathability, bendability, strength, moisture absorption, weight, abrasion resistance, and/or a combination thereof. These characteristics may be accomplished by selecting a particular single layer or multi-layer knit structure (e.g., a ribbed knit structure, a single jersey knit structure, or a double jersey knit structure), by varying the size and tension of the knit structure, by using one or more yarns formed of a particular material (e.g., a polyester material, a relatively inelastic material, or a relatively elastic material such as spandex), by selecting yarns of a particular size (e.g., denier), and/or a combination thereof. The knitted component 132 may also provide desirable aesthetic characteristics by incorporating yarns having different colors, reflectivity, textures or other visual properties arranged in a particular pattern.

The yarns themselves and/or the knit structure formed by one or more of the yarns of the knitted component 132 may be varied at different locations such that the knitted component 132 has two or more portions with different properties (e.g., a portion forming the throat area 112 of the upper 102 may be relatively elastic while another portion may be relatively inelastic). In some embodiments, the knitted component 132 may incorporate one or more materials with properties that change in response to a stimulus (e.g., temperature, moisture, electrical current, magnetic field, or light).

For example, the knitted component 132 may include yarns formed of a thermoplastic polymer material (e.g., polyurethanes, polyamides, polyolefins, and nylons) that transitions from a solid state to a softened or liquid state when subjected to certain temperatures at or above its melting point and then transitions back to the solid state when cooled. The thermoplastic polymer material may provide the ability to heat and then cool a portion of the knitted component 132 to thereby form an area of fused or bonded or continuous material that exhibits certain advantageous properties including a relatively high degree of rigidity, strength, and water resistance, for example.

The knitted component 132 may include a seamless portion extending from the toe area 124, through a midfoot area 120, and to a heel area 122 on at least one of a lateral side and a medial side of the upper. In some embodiments, the knitted component 132 may include a first edge and a second edge, which may be terminal ends of the knitted component 132 after the knitting process when the knitted component 132 is removed from the knitting machine. After the knitting process, the knitted component 132 may be folded or otherwise manipulated such that a first edge and the second edge are secured together at a seam 140 during formation of the upper 102. The seam 140 may be located on the lateral side 106 of the upper 102, on the medial side 108 of the upper 102, and/or in another location (e.g., at the back of the heel area 122 of the upper as shown in FIG. 1). Forming the upper 102 such that it is in an appropriate shape for inclusion in an article of footwear may further include lasting the upper 102. An example of a lasting process is described in U.S. patent application Ser. No. 12/848,352, filed Aug. 2, 2010, and issued as U.S. Pat. No. 8,595,878, which is herein incorporated by reference in its entirety.

When forming the knitted component 132, the knitted component 132 may be oriented with respect to a needle bed of a knitting machine such that a feeder of the knitting machine is capable of moving in a single pass (i.e., without changing its feed direction direction) to knit a first course 150 (see FIG. 5B and FIG. 5C) from the lateral side 106 to the medial side 108 of the knitted component. As such, as the courses are formed that are parallel to the first course 150, the toe area 124 of the knitted component 132 will be formed first, followed by the midfoot area 120 of the knitted component 132, and then the heel area 122 of the knitted component 132 (and/or vice versa, such that it is formed from heel to toe). Thus, when the knitted component 132 is formed and removed from the knitting machine, the first course 150 (which may include one or more yarns dispensed from a feeder during the single pass) may extend at least partially between the medial side and the lateral side of the knitted component.

In some embodiments, the first course 150 may include a continuous strand of yarn that extends between the lateral and medial side of the upper 102. Additionally or alternatively, one or more strands of yarn forming at least a portion of the first course 150 may extend less than the full length of the first course 150. For example, it is contemplated that a strand of yarn may extend from one side of the upper (such as a lateral or a medial side) to the other side of the upper, but may terminate within the first course 150 prior to reaching the other side. In one non-limiting example, one strand of yarn may extend from a lateral side towards a medial side when forming a course but terminate before it reaches the medial side. The course may continue in an uninterrupted manner towards the medial side, but with an additional or alternative strand of a different second yarn picking up where the first yarn terminated. Alternatively, a first and second strand can be combined such that the course is knitted with a combination of the first and second strand of yarn.

Figure 2:
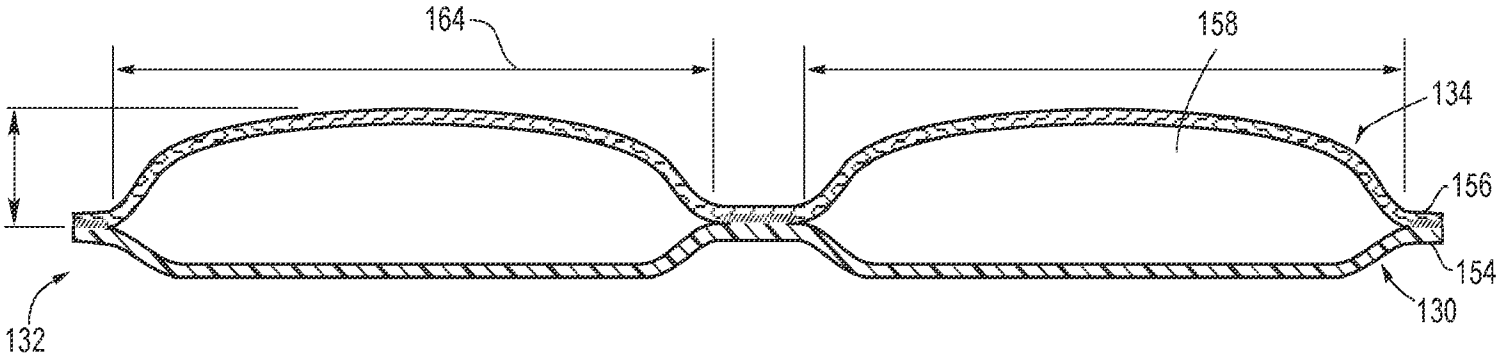
FIG. 2 is an illustration showing two layers of a knitted component in a flat orientation and prior to a shrinkage step in accordance with certain aspects of the present disclosure.
Figure 3:
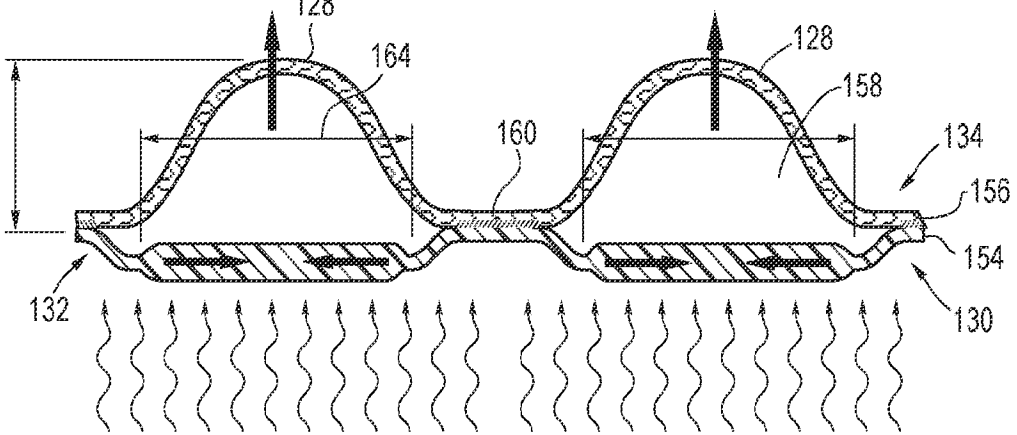
FIG. 3 is an illustration showing the knitted component of FIG. 2 during a shrinkage step in accordance with certain aspects of the present disclosure.
Figure 4B:
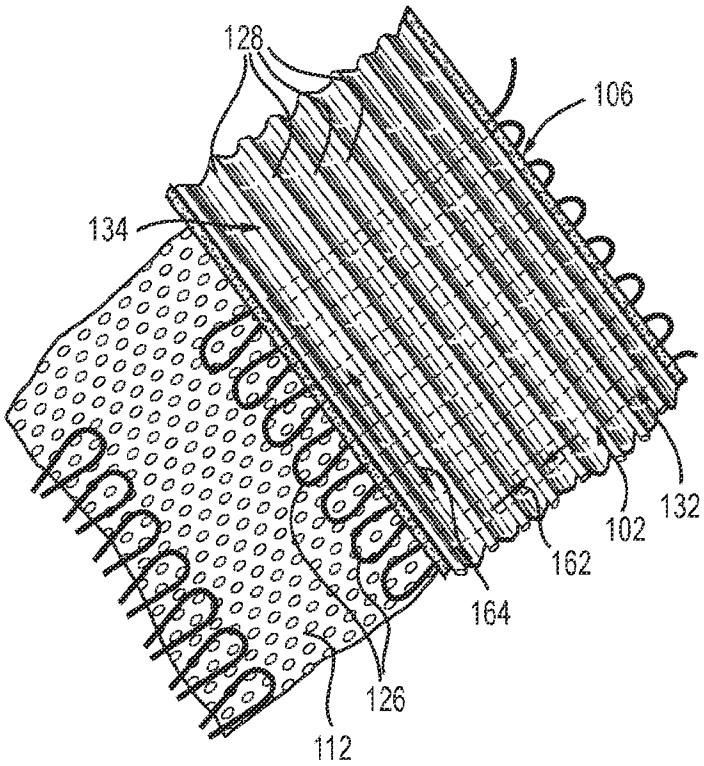
FIG. 4B illustrates a magnified view of raised structures formed upon subjecting the knitted component of FIG. 4A to a heat stimulus.
Figure 4A:
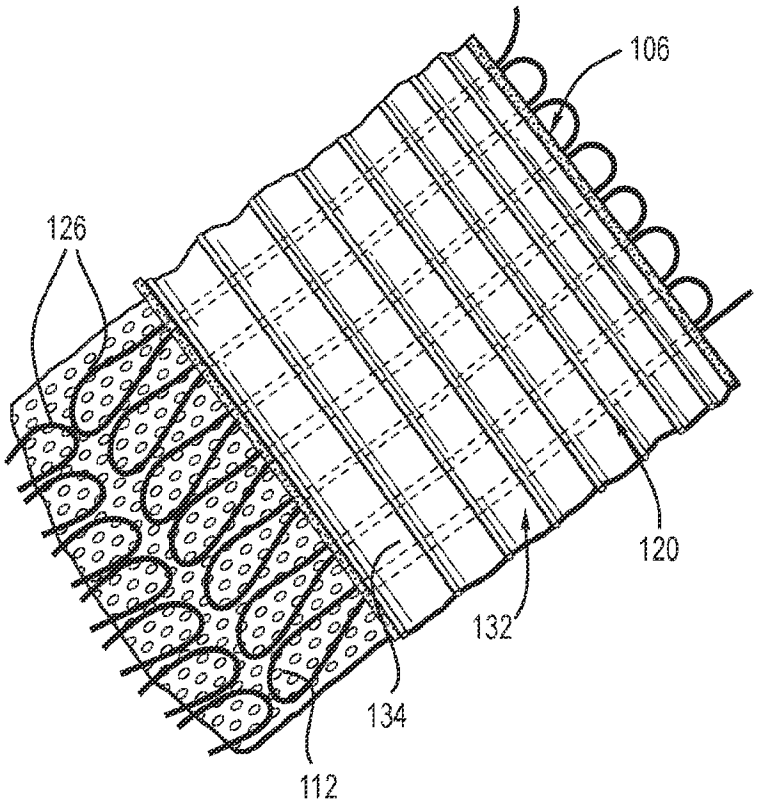
FIG. 4A illustrates a magnified view of a portion of a knitted component before being subjected to a heat stimulus.
Figure 5A:
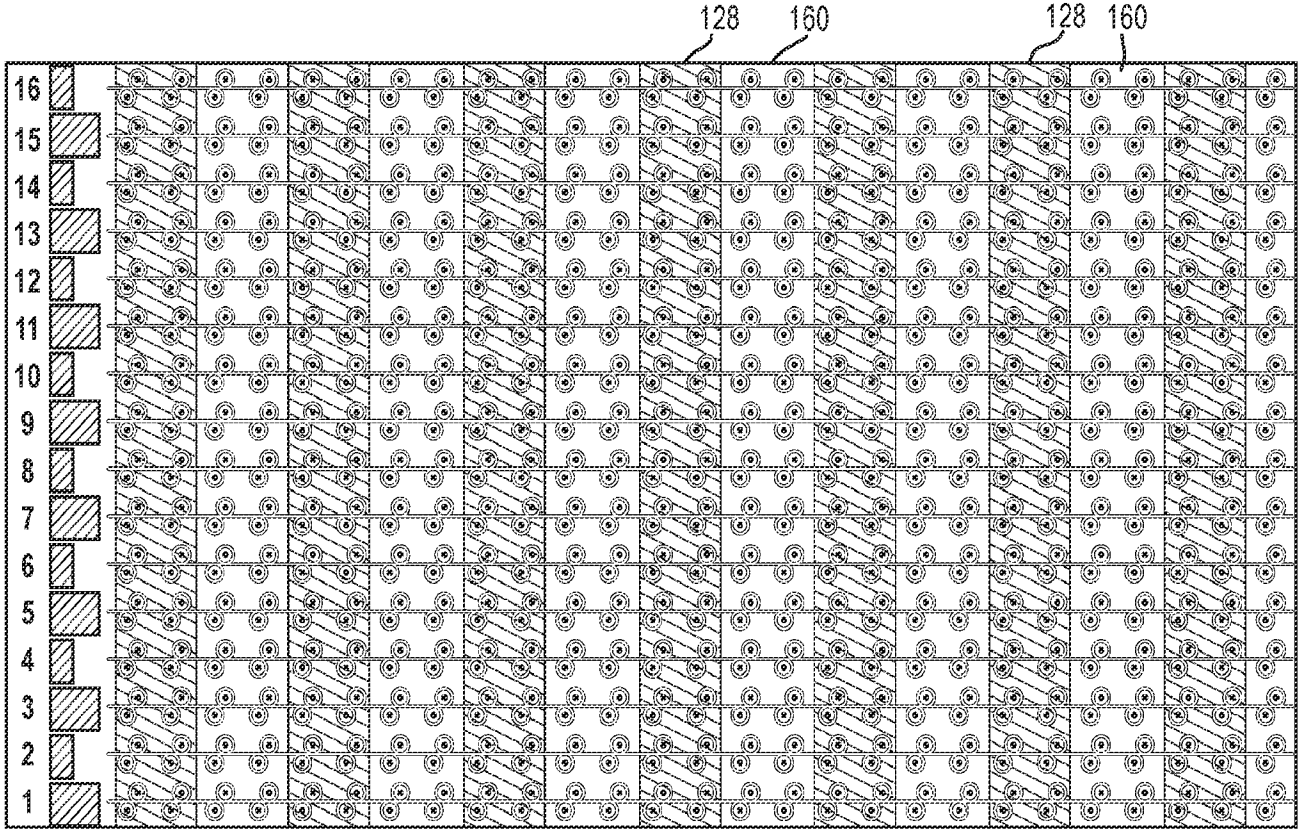
FIG. 5A is a program view of a knitting sequence for forming a knitted component with raised structures in accordance with certain aspects of the present disclosure.
Figure 5B:
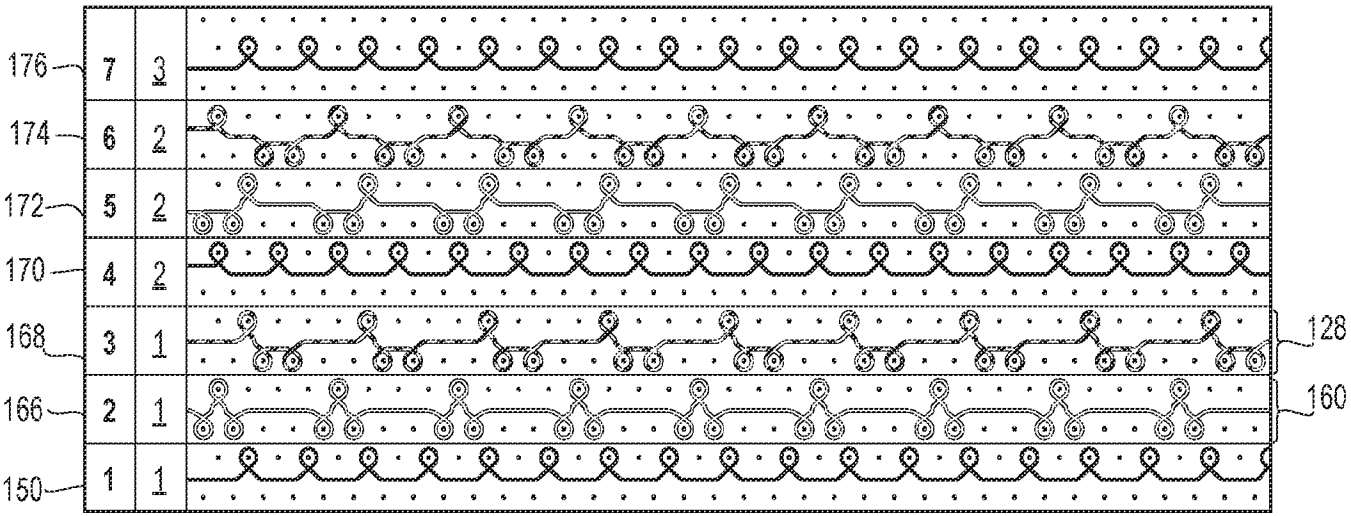
FIG. 5B is a technical view of the knitting sequence depicted in FIG. 5A.

As shown in FIG. 5B (and as described in further detail below), the courses of the knitted component may at least partially form the raised structure 128 of the knitted component 132 and/or portions of the knitted component 132 without raised structures (i.e., such that the course-wise direction extends generally across, or along the width, of the raised structures 128. FIG. 2 and FIG. 3 shows a close-up, cross-sectional view of a portion of the knitted component 132. While FIG. 2 (and FIG. 4A) show a partial view of the knitted component 132 before being subjected to a stimulus (including but not limited to steam heat, for example), FIG. 3 (and FIG. 4B) show a partial view of the knitted component 132 after being subjected to a post-manufacture process or stimulus treatment, including, but not limited to steam.

As shown in FIGS. 2 and 3, at least a portion of the upper 102 may have a first layer 154, a second layer 156, with a pocket 158 formed between the first layer 154 and the second layer 156. In other portions of the upper, the first layer 154 and the second layer 156 are coextensive and/or overlapping, but do not form a pocket there between. The pocket 158 may be filled with another element (e.g., a filler material, such as foam, down, or another suitable material or object), but this is not required, and in exemplary embodiments, the pocket 158 may be empty and/or filled with just air.

The first layer 154 and the second layer 156 may both be formed by knit structures of the knitted component 132 such that the raised structure 128 is primarily formed on a knitting machine with the rest of the knitted component 132. In some embodiments, the above-described a single course may form at least one of the first layer 154 and the second layer 156 of the raised structure 128 and preferably a single course may form at least a portion of both the first and second layer of the raised structure 128.

When the knitted component 132 is included in an upper, the second layer 156 may form an external surface of an upper and the first layer 154 may form an inner surface of the upper. The first course 150 may extend along a direction that herein defines "a first direction" (which is illustrated as lateral to medial direction, generally along an x-axis as shown in FIG. 1). The first direction may be approximately horizontal when the knitted component 132 is incorporated into an upper, for example, and/or when the knitted component 132 is being formed on a knitting machine (such that the "first direction" is parallel to the needle bed). The length of at least one raised structure 128 (or the length of a plurality of raised structures) may extend longitudinally in a second direction, where the second direction may be generally angled with respect to the first direction. In one non-limiting example, the second direction may be generally perpendicular to the first direction.

In such an arrangement, at least one raised structure 128 and/or a plurality of the raised structures 128 extend in a heel to toe direction, generally along a y-axis as shown in FIG. 1. This may be referred to herein and by one of skill as a "vertical ottoman" structure. In other words, the raised structure 128 or ottoman extends generally between the heel and toe and angled with respect to the course-wise direction of the knitted upper. In one non-limiting example, being angled with respect to the course-wise direction may include the raised structure 128 being generally perpendicular to the course-wise direction. Thus, as the upper 102 is being formed by consecutive knit courses that extend in a lateral to medial direction (the first direction), the upper 102 may be coming off the knitting machine with either the heel region or toe region first, and the vertical ottoman structure extending longitudinally, generally in a heel-to-toe direction (the second direction). In other embodiments, certain raised structures 128 may extend diagonally between the heel and toe such that one or more of the raised structures 128 are not totally parallel with the y-axis but rather, are angled and/or extend diagonally relative to the y-axis, generally in a heel-to-toe direction. In one embodiment as shown in FIG. 1, one or more of the raised structures 128 may extend generally along the y-axis in a toe area 124 and/or midfoot area 120 and as the raised structure extends towards the heel area 122, it may angle upwards or diagonally and/or angled with respect to the y-axis. It is also contemplated that one or more of the raised structures 128 extend in respective different directions from one another.

A raised structure 128 may include a length 162 along the second direction (e.g., heel-to-toe in FIG. 1) and a width 164 along the first direction (e.g., medial-to-lateral in FIG. 2 and FIG. 3). The length may be greater than the width. It is contemplated that, with a high length-to-width ratio, the raised structure 128 can be given appropriate characteristics for forming a suitable ottoman knit structure (sometimes also referred to as a "welt" knit structure) where the second layer 156 is raised or bulged and extends outwardly and away from the first layer 154, as shown in FIG. 4B and by the vertically pointing arrows in FIG. 3. In some embodiments, the length 162 of the raised structure 128 may be at least 25% larger than the width 164, at least 50% larger than the width 164, at least twice the width 164, at least five times the width 164, or greater than five times the width 164. The length of raised structure 128 on a single article can vary, or each raised structure 128 on a single article can have the same length.

A variety of processes are contemplated for creating the raised structure 128 (i.e. a vertical ottoman), and these processes may occur during or after the knitting process for forming the knitted component 132. For example, the upper may be knit on a knitting machine having a front bed and a back bed. In one example, a yarn knit on the back bed may ultimately form the first side 130 forming an inner surface of the upper 102 (e.g., facing the void of the article of footwear). A yarn knit on the front bed may ultimately form the second side 134 forming an outer surface of the upper 102 (e.g. facing generally opposite the first side 130), as shown in FIG. 3.

One or more yarns may be used when knitting the knitted component. In one non-limiting example, a first yarn may be used to form at least a portion of the first side 130 of the knitted component forming an inner surface of an upper. The first yarn may include, for example a relatively elastic yarn. One or more ends of the first yarn may be used, such as one end, two or more ends. Preferably, in this example, one end of the first yarn may be used. In one non-limiting example, the first yarn may be an "E04"-type yarn supplied by Unifi, Inc. of Greensboro, N.C., which preferably has a relatively high elasticity compared to other yarns that may be used to form the knitted component. The first yarn may comprise a spandex core (i.e. Lycra) wrapped with polyester. It may have a denier range of 800-1100, and a tensile strength of >0.75 and an elongation of 180-250. In some embodiments, such as when it is desirable for the first yarn to reduce in size during the manufacturing process, the shrinkage rate of the first yarn may be higher relative to other yarns used to form the knitted component when subjected to heat (or another stimulus). In other words, when subjected to heat (e.g., via steam), the first yarn may shrink more, and/or at a higher rate, than the other yarns used to form the knitted component. Features associated with a relatively-high shrinkage rate are described in more detail below.

A second yarn may be used to form at least a portion of the second side 134, or outer surface, of the knitted component. The second yarn may be the same as the first yarn or it may be different. In one example, the second yarn used to form at least a portion of the second side 134 of the knitted component (which forms at least a portion of the outer surface of the upper) is a yarn that has different properties relative to the first yarn. In one example, the second yarn is a relatively inelastic yarn. One or more ends of the second yarn may be used, such as one end, two ends or more than two ends. For example, four ends of the second yarn may be used. This second yarn may be referred to as "P16" provided by Unifi, Inc. of Greensboro, N.C., which may have a relatively low elasticity compared to other yarns that may be used to form the knitted component. The second yarn may be formed primarily of a strand, or multiple strands, of textured polyester. It may have a denier range of approximately 155D to approximately 180D, a tensile strength of about 0.5 to 0.7 and an elongation of 20-40. The shrinkage rate of the second yarn may be lower relative to other yarns used to form the knitted component. In other words, when subjected to a similar amount of heat, (e.g., such as via steam), the second yarn may shrink much less if at all, and/or at a lower rate, than the other yarns used to form the knitted component.

In addition to the first and second yarn used to form the knitted component, a third yarn may be used to form the knitted component. The third yarn may be the same as the first yarn and/or the second yarn, or it may be different. In one example, the third yarn used to form at least a portion of the knitted component comprises a yarn that is different than the first yarn and the second yarn. In one example, the third yarn is relatively less elastic than the first yarn (E04) but is relatively more elastic than the second yarn (P16). The third yarn may be a combination of materials or strands. In one example, the third yarn may comprise a combination of a polyester yarn with an elastic core and a yarn formed of a thermoplastic polymer material, sometimes referred to as a "fusible yarn." The polyester yarn with an elastic core may be referred to as "P15" (which, in one example, is a strand of the P16 mentioned above, air tacked to a strand of spandex). The yarn formed of a thermoplastic polymer material, or fusible yarn may be a polyester that melts at about 60° C. In one non-limiting example, the fusible yarn may be approximately 150 denier, comprising 34 continuous filaments. Thus, the third yarn may be a combination of a polyester yarn (i.e. P15) and a yarn formed of a thermoplastic polymer material, or "fusible yarn." The combination of materials, such as the polyester yarn and the fusible yarn that together form the third yarn may be achieved by twisting, winding, braiding, and or wrapping on about the other and the like, and/or the yarns may be a core/sheath configuration, and/or the yarns may be tacked along their length at a plurality of points.

One or more ends of the third yarn may be used, such as one end, two ends or more than two ends. Preferably, in this example, the third yarn comprises a combination of four ends of P15 and one end of a fusible yarn. The elastic (i.e. Lycra) core of the P15 allows the third yarn to have a greater elasticity than the second yarn (i.e. P16 yarn), but a lower elasticity than the first yarn (the elastic E04 yarn). The third yarn may have a denier range of approximately 160D to approximately 190D, a tensile strength of about 0.5 to 0.7 and an elongation of 25-45. The shrinkage rate of the third yarn may be lower relative to the first yarn and greater relative to the second yarn used to form the knitted component when subjected to heat or another stimulus. In other words, when subjected to a similar amount of heat (e.g., via steam), the third yarn may shrink relatively more than the second yarn and relatively less than the first yarn used to form the knitted component.

During or after the knitting process, a stimulus, such as heat, may be applied to at least a portion of, or to the entirety of the upper. This heat may be in the form of steam, such as by a steam-providing device, for example. One or more effects may result from the exposure of the knitted component to steam.

In one example, the steam may cause one or more of the yarns used to form the knitted component to shrink at different relative rates, thus forming the raised structure 128. For example, the steam may cause the first yarn (e.g. the relatively highly elastic E04 yarn) to shrink at a higher degree and/or rate than the second and third yarns used to form the knitted component. The third yarn (or P15 yarn), which is relatively less elastic than the first yarn but relatively more elastic than the second yarn, may also shrink in response to the steam heat stimulus, but less so than the first yarn. The second yarn (i.e. P16) which is a relatively inelastic yarn has relatively little or insignificant shrinkage in response to the steam heat stimulus.

In one non-limiting example relating to relative shrinkage rates, three different test swatches were knitted, each swatch knitted exclusively from one type of yarn. In this example, the test swatches were each knitted in a jacquard structure and then exposed to a steam heat stimulus. The first swatch was knitted entirely of the first yarn, or "E04" type yarn. The second swatch was knitted entirely of the second yarn, or "P16" type yarn. The third swatch was knitted entirely of the third yarn, of "P15" type yarn. After steaming, the shrinkage rates were as follows, with the percentage (%) representing the percentage of shrinkage of the width of the original swatch:

E04: Shrinkage in Wales 11%, Courses 11%.

P15: Shrinkage in Wales 9%, Courses 22%.

P16: Shrinkage in Wales 9%, Courses 11%.

In another example, the steam may also activate thermoplastic polymer materials in the third yarn. Once this heat is removed and the article cools, the thermoplastic material present in the third yarn (i.e. the one end of "fusible yarn" present in the third yarn) may at least partially fuse together with adjacent yarns in its proximity to within the knitted component. When the thermoplastic material transitions back to a solid state upon cooling, this may cause the fused yarns to remain fixed in (or at least have a tendency to remain fixed in) a desirable position and orientation. Heat-processing the fusible material of the fusible yarn may also enhance the rigidity, strength, and other mechanical properties of the knitted component at least in select locations.

As shown in FIGS. 2-3, the first yarn may be used to form at least a portion of the first side 130 of the knitted component forming an inner surface of an upper (e.g., facing a void). The second yarn may be used to form at least a portion of the second side 134, or outer surface, of the knitted component. Prior to exposing the knitted component to a stimulus, the second side 134 may be generally flat, overlapping and generally coextensive to the first side 130 as shown in FIG. 2. Alternatively, prior to exposing the knitted component to a stimulus, the raised structure 128 may be partially visible as shown in FIG. 4A, but not as pronounced and/or defined as shown in FIG. 4B which illustrates one example of the knitted component after exposure to a stimulus. When exposed to a stimulus, such as steam, the first yarn of the first side 130 shrinks, while the second yarn on the second side 134 of the knitted component has relatively little or insignificant shrinkage. The shrinkage of the first yarn causes the second yarn to buckle or bulge outward as shown in FIG. 4B and by the vertically oriented arrows in FIG. 3 to form a raised structure 128 that extends outwardly and away from the first side 130 of the knitted component. In other words, the relative difference in shrinkage among the different yarns used to form the knitted component upon exposure to a stimulus results in the formation of a raised structure 128 or "ottoman."

As shown in FIG. 3, the third yarn (i.e. the P15 combined with fusible yarn) forms at least a portion of the second side 134, or outer surface of the knitted component. The third yarn may be located between one or more of the raised structures 128. In other words, the third yarn may form a valley 160 between one or more of the raised structures 128 on the second side 134 as shown in FIG. 3. As noted above, the third yarn (P15+fusible) has a relatively higher degree of shrinkage as compared to the second yarn (P16). This may be at least partially attributable to the tendency of the material forming the third yarn to shrink when subjected to heat or another stimulus. Therefore, when the knitted component is exposed to a stimulus such as steam, the resulting shrinkage of the third yarn may help to "pinch" together and define the sides of the raised structure 128 or ottoman. Furthermore, the thermoplastic material component (i.e. the fusible yarn component of the third yarn) may transition from a solid state to a softened or liquid state when subjected to certain temperatures at or above its melting point during steaming, and then transition back to the solid state when cooled. As such, the third yarn may be at least partially fused to the first yarn which forms the first side 130, or inner surface of the knitted component. In one example, the presence of the third yarn on the second side 134, or outer surface of the knitted component, may therefore serve to form a valley 160 located between raised structures 128 to better define the loft of the raised structure 128. Furthermore, by fusing to the first yarn of the first side 130, the third yarn may provide enhanced stability, lock down, rigidity and or stability to the knitted component when formed into an upper for an article of footwear.

Figure 5C:
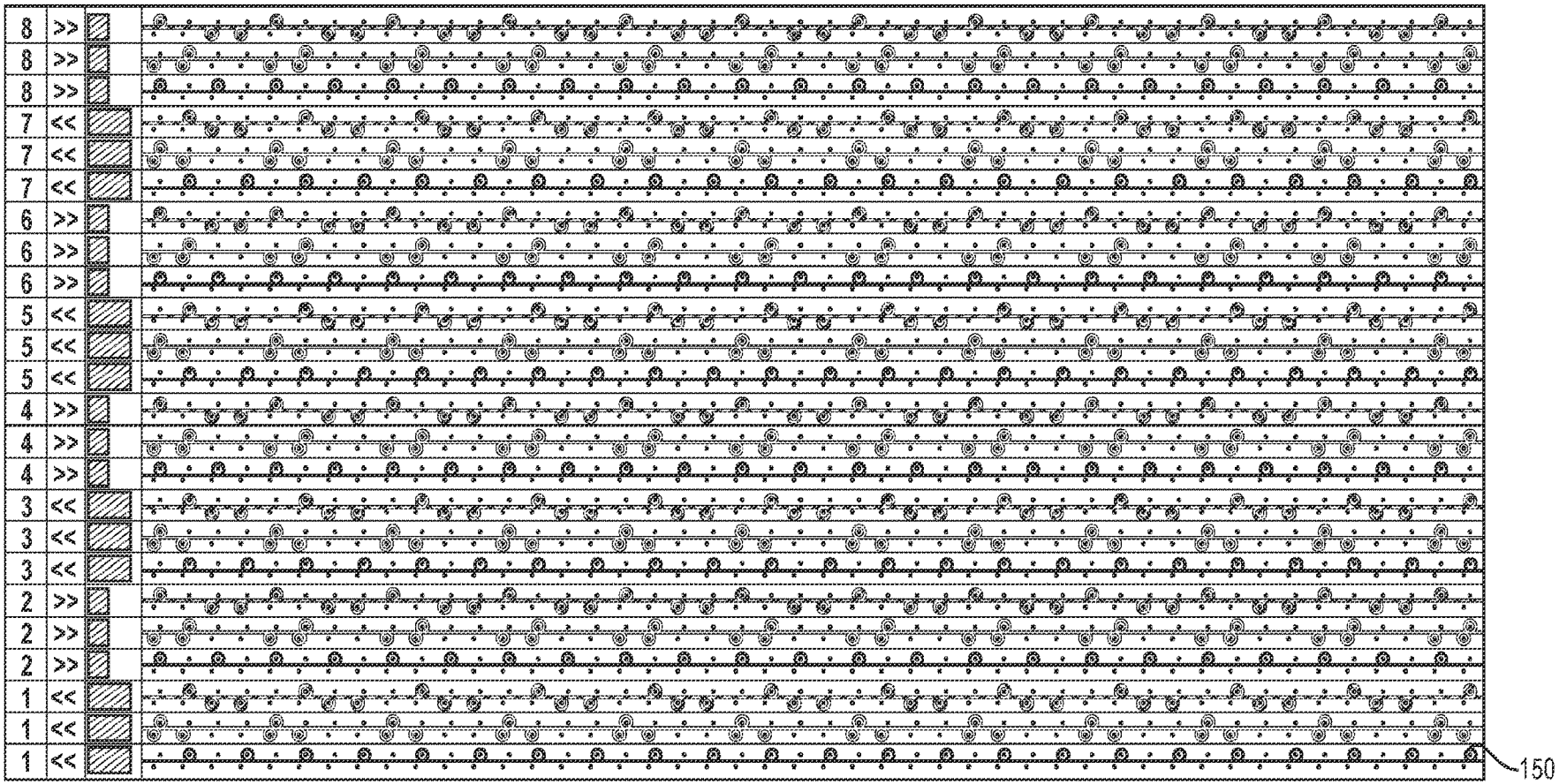
FIG. 5C is a process view of the knitting sequence depicted in FIGS. 5A-5B.

Turning now to FIGS. 5A-5C, a knit program used to form a knitted component comprising one or more raised structures 128 ("welts" or "ottomans") as identified herein will be described. First, looking to FIG. 5A, a program view of the vertical ottomans ("welts") formed on at least a portion of the second side 134, or outer surface of the knitted component is illustrated. As shown there, a series of vertical regions or stripes are depicted. When viewed in color, the red vertical regions (or, when in black and white, the darker vertical stripe) represent a raised structure 128 (i.e. a "welt" or "ottoman") formed on the second side 134 or outer surface of the knitted component. The yellow (or lighter when viewed in black and white) vertical regions or stripes represent a valley 160 located between each of the raised structures 128. Thus, it can be seen that there is one valley 160 comprised of the third yarn located between each of the raised structures 128 formed of the second yarn.

Next, looking to FIG. 5B, a knit diagram illustrating the "technical view of the vertical welts" is shown. It is noted that the knit diagram of FIG. 5B is an enlarged portion of the process view of vertical welts (i.e. raised structures or ottomans) shown in FIG. 5C. In other words, this knit diagram of FIG. 5B and FIG. 5C represents the formation of at least a portion of the knitted component on a knitting machine having two needle beds, a front bed and a back bed.

Looking specifically to FIG. 5B, the front needle bed is represented by the series of dots (needles) on the bottom row of each course, while the back needle bed is represented by the series of dots (needles) on the top row of each course. The portion of the knitted component shown in FIG. 5B has at least seven courses comprising at least two raised structures 128 and at least two "valleys" 160 located between the raised structures 128.

Looking to the first course 150, the first yarn (E04) is knit on the back needle bed only, while the front needle bed of the first course 150 remains empty. As shown, the first yarn is knit on every other needle of the back bed to form at least a portion of the first side 130, or inner surface of the knitted component. Using every other needle on the back bed (as opposed to all needles on the back bed) may help to avoid the first side 130 from becoming too rigid and/or brittle, and it may provide empty needles that can be utilized for other knit actions (e.g., knitting loops of the second and/or third yarns on the back needle bed to couple the second layer 156 to the first layer 154 (see FIG. 3) at the valleys 160 between the raised structures 128).

Next, looking to the second course 166 of FIG. 5B, the third yarn (P15) is knit on both the front and back needle beds. Specifically, as shown, the third yarn is knit on two needles, then skips two needles on the front bed. The third yarn is knit on every third needle on the back bed. It is noted that where the third yarn is present on the front needle bed, the second yarn (P16) is absent. As such, this results in the formation of raised structures 128 of the second yarn separated by "valleys" 160 formed by the third yarn on the second side 134 or outer surface of the knitted component. Where the third yarn is present on every fifth needle on the back bed (forming a portion of the first side 130 or inner surface of the knitted component), the thermoplastic material component of the third yarn may fuse with the first yarn (E04) also present on the first side 130 when the knitted component is heat processed (e.g., after knitting). This may help form the "valley" 160 between raised structures 128, further pinch and/or close the sides of the adjacent raised structure 128, and define the raised structure and provide additional stability to the knitted component when it is formed into an upper 102.

Next, looking to the third course 167 depicted in the knit diagram, the second yarn (P16) is knit on both the front and back needle beds. Specifically, as shown, the second yarn is knit on two needles, then skips two needles on the front bed. The second yarn is knit on every fifth needle on the back bed. By pulling the second yarn to the back bed to knit the second yarn on at least one needle at regular and space apart intervals (such as every fifth needle of the back needle bed as shown) the second yarn can be locked to the first side 130 or inner surface of the knitted component. As noted above, where the second yarn is present on the front needle bed, the third yarn (P15) is absent. As such, this results in the formation of raised structures 128 formed by the second yarn separated by the valleys 160 formed by the third yarn. Upon steaming or other application of heat, the second yarn knitted on the front needle bed (forming the second or outer surface) will warp, bulge, and/or buckle as the first yarn knitted on the back needle bed (forming the first or inner surface) shrinks. The shrinkage of the first yarn allows the raised structure 128 or ottoman to form and extend away from the first side 130 (inner surface).

Next, looking to the fourth course 170, the first yarn (E04) is again knit on every other needle of the back bed, while leaving the front needle bed empty. This is a repeat of the knitting pattern of the first course 150 described above. Knitting the fourth course 170 of the first yarn forms a portion of the first side 130 or inner surface of the knitted component. When the knitted component is subjected to a stimulus such as steam, the shrinkage of the first yarn of the fourth course 170 allows the second yarn of the third and/or sixth course to buckle or bulge outwardly, forming a raised structure 128 formed from the second yarn.

Next, looking to the fifth course 172, the third yarn (P15) is again knit on both the front and back needle beds. As shown, the third yarn is knit on two needles and then skips two needles on the front bed. On the back needle bed, the third yarn is knit on every fifth needle. The fifth course 172 of yarn forms at least part of the valley 160 located between the raised structure or ottoman formed by the second yarn of the third course 168 and the additional raised structure or ottoman formed by the second yarn of the next (or sixth) course 174 described below.

Next, looking to the sixth course 174, the second yarn (P16) is again knit on both the front and back needle beds. As shown, the second yarn is knit on two needles and then skips two needles on the front bed. On the back needle bed, the second yarn is knit on every fifth needle. By pulling the second yarn to the back bed at regular and space apart intervals (such as every fifth needle as shown) the second yarn can be locked to the first side 130 or inner surface of the knitted component. The sixth course 174 of yarn forms another raised structure 128 (or ottoman or welt) adjacent to the raised structure 128 (or ottoman or welt) formed by the third course 168 described above. The "valley" 160 formed by the third yarn of the fifth course 172 mentioned above is located on one side of the raised structure 128 formed by this sixth course 174.

Next, looking to the seventh course 176, the first yarn is again knit on every other needle of the back bed, while leaving the front needle bed empty. This is a repeat of the knitting pattern of the first course 150 and fourth course 170 described above. Knitting the seventh course 176 of the first yarn forms a portion of the first side 130 or inner surface of the knitted component. When the knitted component is subjected to a stimulus such as steam, the shrinkage of the first yarn of the seventh course 176 allows the second yarn of the sixth course 174 to buckle or bulge outwardly, forming a raised structure 128 formed from the second yarn knitted by the sixth course 174.

The knit sequence of FIG. 5B may be repeated, as necessary, to form a knitted component with a suitable size. Further, it is noted that the sequence(s) may be varied to incorporate different features by changing certain knit structures, by varying yarn types, by increasing or decreasing the number of courses at each step, or by any other suitable adjustment to the knitting process or materials used. Further, other sequences may be used before, after, or between the sequences of FIG. 5B.

While the embodiments of the raised structure 128 and other features are described generally herein with reference to an upper 102 for an article of footwear, those features could additionally or alternatively be incorporated into another type of article. For example, knitted raised structures 128 may be included in articles of apparel (e.g., shirts, pants, socks, footwear, jackets and other outerwear, briefs and other undergarments, hats and other headwear), containers (e.g., backpacks, bags), and upholstery for furniture (e.g., chairs, couches, car seats).

In the present disclosure, the ranges given either in absolute terms or in approximate terms are intended to encompass both, and any definitions used herein are intended to be clarifying and not limiting. Notwithstanding that the numerical ranges and parameters setting forth the broad scope of the present embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the present disclosure encompasses any and all possible combinations of some or all of the various aspects described herein. It should also be understood that various changes and modifications to the aspects described herein will be apparent to those skilled in the art. Such changes and modifications can be made without departing from the spirit and scope of the present disclosure and without diminishing its intended advantages. It is therefore intended that such changes and modifications be covered by the appended claims.

We claim:

1. A method of knitting a textile comprising:

knitting at least a portion of a first layer from a first yarn having a first shrinkage rate;

knitting at least a portion of a second layer from a second yarn having a second shrinkage rate less than the first shrinkage rate; and exposing the textile to heat to shrink the first yarn to a greater degree than the second yarn, wherein shrinking the first yarn to the greater degree than the second yarn forms an elongated raised structure that extends perpendicular to a course-wise direction of the first yarn.

2. The method of claim 1, wherein the first yarn is at least twice as elastic as the second yarn.

3. The method of claim 1, wherein the elongated raised structure is an ottoman.

4. The method of claim 1, further comprising:

forming the textile into at least a portion of an upper such that the elongated raised structure is disposed on an outer side of the textile; and securing the upper to a sole structure.

5. The method of claim 1, wherein the step of exposing the textile to heat includes applying steam to at least a portion of the textile.

6. The method of claim 1, wherein the elongated raised structure includes a first vertical region that extends parallel to a second vertical region, a valley extending between the first vertical region and the second vertical region.

7. The method of claim 6, wherein the valley is at least partially formed of a third yarn that comprises a fusible material.

8. The method of claim 1, wherein the first layer is knitted on a back needle bed of a knitting machine and the second layer is at least partially knitted on a front needle bed of the knitting machine.

9. The method of claim 8, wherein the elongated raised structure includes a first vertical region that is parallel to a second vertical region, a valley extending between the first vertical region and the second vertical region, wherein the valley is at least partially formed of a third yarn, and wherein the third yarn is knitted onto the front needle bed and the back needle bed.

10. The method of claim 9, wherein the third yarn comprises a fusible material.

11. A method of knitting a textile comprising:

knitting at least a portion of a first layer from a first yarn having a first shrinkage rate;

knitting at least a portion of a second layer from a second yarn having a second shrinkage rate less than the first shrinkage rate; and exposing the textile to heat to shrink the first yarn to a greater degree than the second yarn, wherein shrinking the first yarn to a greater degree than the second yarn forms a first vertical region parallel to a second vertical region with a valley therebetween, and wherein the valley is at least partially formed from a third yarn that comprises a fusible material.

12. The method of claim 11, wherein the first yarn is at least twice as elastic as the second yarn.

13. The method of claim 11, wherein each of the first vertical region and the second vertical region is an ottoman.

14. The method of claim 11, wherein the third yarn further comprises a polyester yarn.

15. The method of claim 11, further comprising: forming the textile into at least a portion of an upper such that the first vertical region and the second vertical region are each disposed on an outer side of the textile.

16. The method of claim 15, further comprising securing the upper to a sole structure.

17. The method of claim 11, wherein the step of exposing the textile to heat includes applying steam to at least a portion of the textile.

18. The method of claim 11, wherein the first layer is knitted on a back needle bed of a knitting machine and the second layer is at least partially knitted on a front needle bed of the knitting machine.

19. A method of knitting a textile comprising:

knitting at least a portion of a first layer from a first yarn having a first shrinkage rate;

knitting at least a portion of a second layer from a second yarn having a second shrinkage rate less than the first shrinkage rate; and exposing the textile to heat, wherein the exposing the textile to heat forms a first length of a first vertical region that extends parallel to a second length of a second vertical region in the textile, wherein the first length is longer than a first width of the first vertical region, wherein the second length is longer than a second width of the second vertical region, and wherein a valley extends between the first vertical region and the second vertical region.

20. The method of claim 19, wherein the first yarn is fused to a third yarn on a first side of the valley, and wherein the second yarn is fused to the third yarn on a second side of the valley.

* * * * *